US008591263B2

(12) United States Patent
Hayashi

(10) Patent No.: US 8,591,263 B2
(45) Date of Patent: Nov. 26, 2013

(54) CONNECTOR FOR CONNECTING CABLE AND TERMINAL OF SAME

(75) Inventor: Masanori Hayashi, Sagamihara (JP)

(73) Assignee: Molex Incorporated, Lisle, IL (US)

( * ) Notice: Subject to any disclaimer, the term of this patent is extended or adjusted under 35 U.S.C. 154(b) by 815 days.

(21) Appl. No.: 12/224,696

(22) PCT Filed: Mar. 5, 2007

(86) PCT No.: PCT/US2007/005687

§ 371 (c)(1),
(2), (4) Date: Aug. 22, 2011

(65) Prior Publication Data

US 2011/0294341 A1 Dec. 1, 2011

(51) Int. Cl.
*H01R 24/00* (2011.01)

(52) U.S. Cl.
USPC ..... 439/630; 439/495

(58) Field of Classification Search
USPC ..... 439/492, 630, 495
See application file for complete search history.

(56) References Cited

U.S. PATENT DOCUMENTS 5,542,855 A 8/1996 Asai
6,030,246 A * 2/2000 Kunishi ..... 439/329
6,089,905 A * 7/2000 Shimmyo et al. ..... 439/495
6,971,918 B1 * 12/2005 Su et al. ..... 439/630
7,083,455 B1 * 8/2006 Miura et al. ..... 439/260
7,104,846 B1 * 9/2006 Yen ..... 439/630
7,275,963 B2 * 10/2007 Kurita ..... 439/630
8,109,794 B2 * 2/2012 Tanaka et al. ..... 439/630
2006/0281361 A1 12/2006 Uchida et al.

FOREIGN PATENT DOCUMENTS

JP H01-112424 U 6/1991
JP H08-011384 A 8/1997
JP H08-268860 A 5/1998
JP H10-132403 A 11/1999
JP H10-239982 A 3/2000
JP H11-257755 A 2/2001
JP 2002-061973 A 9/2003
WO 2004098249 A1 11/2004

OTHER PUBLICATIONS

International Search Report for PCT/IB2007/004698.

* cited by examiner

*Primary Examiner* — Hien Vu
(74) *Attorney, Agent, or Firm* — Timothy M. Morella

(57) ABSTRACT

A low profile flat printed circuit connector has a plurality of terminals supported along a support bar. The terminals are spaced apart from each other and extend lengthwise in a connector housing. The terminals have body portions that engage the support bar and body portions that extend forwardly thereof. Contact portions are joined to the body portions and extend rearwardly and terminate in free ends so that they form a series of cantilevered contacts.

8 Claims, 3 Drawing Sheets

CONNECTOR FOR CONNECTING CABLE AND TERMINAL OF SAME

BACKGROUND OF THE INVENTION

The present invention generally relates to a connector for connecting a length of flexible printed circuitry to an array of conductive terminals.

In order to provide an electrical connection between flat flexible circuit cable, known as flexible printed circuit (FPC) or flexible flat cable (FFC) and terminals, FPC/FFC cables are known, such as that shown in Japanese Patent Application Laid-Open Application (Kokai) No. 10-116659. FIG. 8 is a cross-sectional view of a conventional cable connector.

The conventional connector has a insulative housing 301 with a plurality of terminal holding spaces 302 partitioned by partitioning walls 307, and a plurality of terminals 303 that are formed of a conductive material such as metal, and are held within the terminal holding spaces 302. The terminals 303 have a U-shaped cross section, with solder tail parts 308 that are connected by soldering to conductive traces on a substrate 311.

The housing 301 is provided with a cable inserting space 309 that spatially connects transversely the upper side of the respective terminal holding spaces 302. The tip of the flat cable 310 inserted from the inserting hole 305 is then inserted into the cable inserting space 309. Each of the terminals 303 has an upper piece 304 that extends upwardly, to make resilient contact with a corresponding lead on the cable 310 inserted into the inserting space 309. The housing 301 has a guide 306 extending obliquely upward from a lower part thereof. The guide 306 covers the area on the side on which the inserting holes 305 of the terminals 303 are disposed, in order that the tips of the flat cables 310 inserted from the inserting holes 305 are guided into the inserting spaces 309.

Nevertheless, in the above conventional cable connector, the U-shape cross section of the terminals 303 increases the vertical dimension, resulting in an increase in the total thickness of the cable connector. Further, guiding the tips of the flat cables 310 into the inserting spaces 309 requires the guide 306 to cover the area on the side on which the inserting holes 305 of the terminals 303 are disposed. This complicates the shape of the housing 301. In addition, the terminal holding spaces 302 are required for holding the respective terminals 303 and these spaces further complicates the shape of the housing 301.

SUMMARY OF THE INVENTION

The present invention is directed to a flat cable connector that overcomes the aforementioned disadvantages and which maintains a low vertical profile. It is therefore an object of the present invention to provide a cable connector and a terminal therefor that permits easy insertion of a flat cable, and permits a reliable connection of the flat cable without causing disengagement thereof from the terminal, with a thin and simple structure while providing the terminal with such an improved configuration such that a front end portion and a rear end portion are arranged to be firmly secured to a substrate, and a free end arranged to be movable in a vertical direction with respect to a surface of the substrate, is disposed between the front end portion and the rear end portion.

To this end, in accordance with one aspect of the present invention, the terminals of the connectors of the invention are adapted for insertion into a cable connector mounted to a surface of a substrate, and for connection to the leads of a flat cable inserted into the connector. The terminal is configured such that a free end thereof extends in an insertion direction of the cable (rearwardly of the connector), and has front and rear end portions that are firmly secured to the surface of the substrate, so that the free end is movable vertically with respect to the surface of the substrate, and is positioned between the front end portion and the rear end portion.

In accordance with another aspect of the present invention, the connector terminal is further provided with a contact part capable of contacting the flat cable leads and extends in the insertion direction, one end of the contact part being connected to the front end portion, and the other end being the free end.

In accordance with one aspect of the present invention, there is provided a cable connector provided with: a body part extending in an insertion direction of a flat cable connected, one end of the body part being connected to a rear end portion; a connecting part extending in the insertion direction, one end of which is connected to the body part, and the other end is connected to a front end portion; and a plurality of terminals, each having a contact part making a contact with a lead of the flat cable, one end of the contact part being connected to the rear end portion, and the other end being a free end. The terminals of the cable connector are provided with a lateral frame part for fixing the body part, and are arranged in parallel to the insertion direction by a terminal supporting member formed of an insulating material.

In accordance with another aspect of the present invention, the connector is configured so that the terminal contact is resilient and is displaced away from the surface of the substrate, when the connector does not have a flat cable inserted thereinto, and is disposed parallel with the connecting part. The contact part and the connecting part and the front end portion of the cable connector are formed integrally on an identical side of the surface of the substrate.

In accordance with a still other aspect of the present invention, there is provided a cable connector configured such that the terminal housing portion thereof includes a pair of holding arm parts that are connected to both ends of a connector base and and extend in the insertion direction.

In accordance with a still other aspect of the present invention, there is provided a cable connector configured with a pair of retaining arms that engages ear, or tab portions on the housing to retain the flat cable in place therein.

In accordance with a still other aspect of the present invention, the cable connector is provided with a cover member secured to the surface of the substrate so as to cover the terminals and the terminal supporting member, and configured to define an inserting hole between the cover member and the surface of the substrate so as to permit insertion of a flat cable therein.

In accordance with the present invention, a cable connector includes a terminal having a front end portion and a rear end portion which are firmly fixed to a substrate, and further having a free end that is movable in a vertical direction with respect to the surface of the substrate, the free end being disposed between the front end portion and the rear end portion. Hence, the cable connector can be thin and simple structure while permitting an easy insertion of the flat cable without causing abutment of the front end portion of the terminal against the flat cable, and also permitting a reliable connection of the flat cable without causing disengagement thereof from the terminal.

BRIEF DESCRIPTION OF THE DRAWINGS

During the course of this detailed description, reference will be frequently made to the drawings wherein like parts are represented by like reference numbers and in which.

DESCRIPTION OF THE PREFERRED EMBODIMENT

Preferred embodiments of the present invention will be described below in detail with reference to the accompanying drawings. The low vertical profile effected by connectors of the present invention make them particularly suitable for use in mobile telephones.

Figure 3:
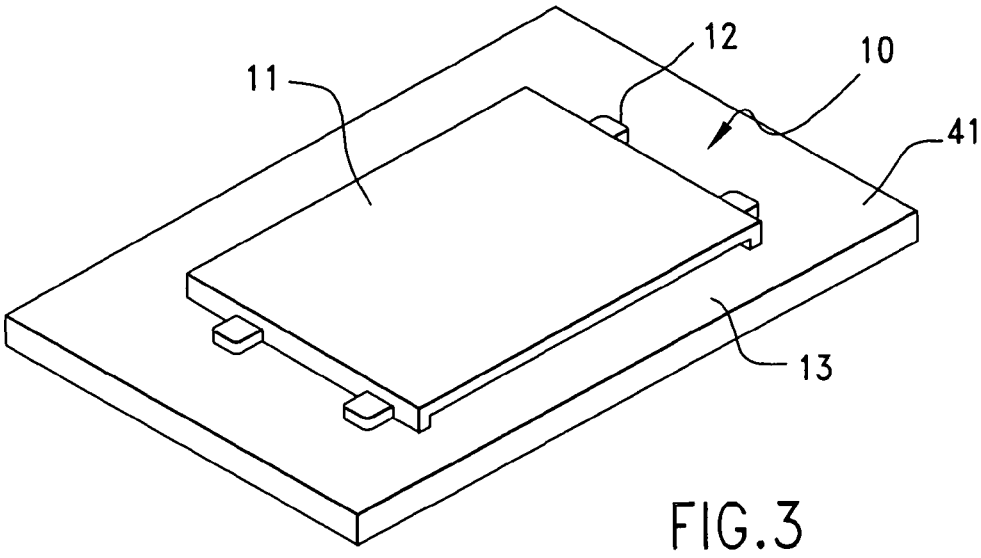
FIG. 3 is the same view as FIG. 2, but with the cover in place on the terminal assembly.
Figure 4:
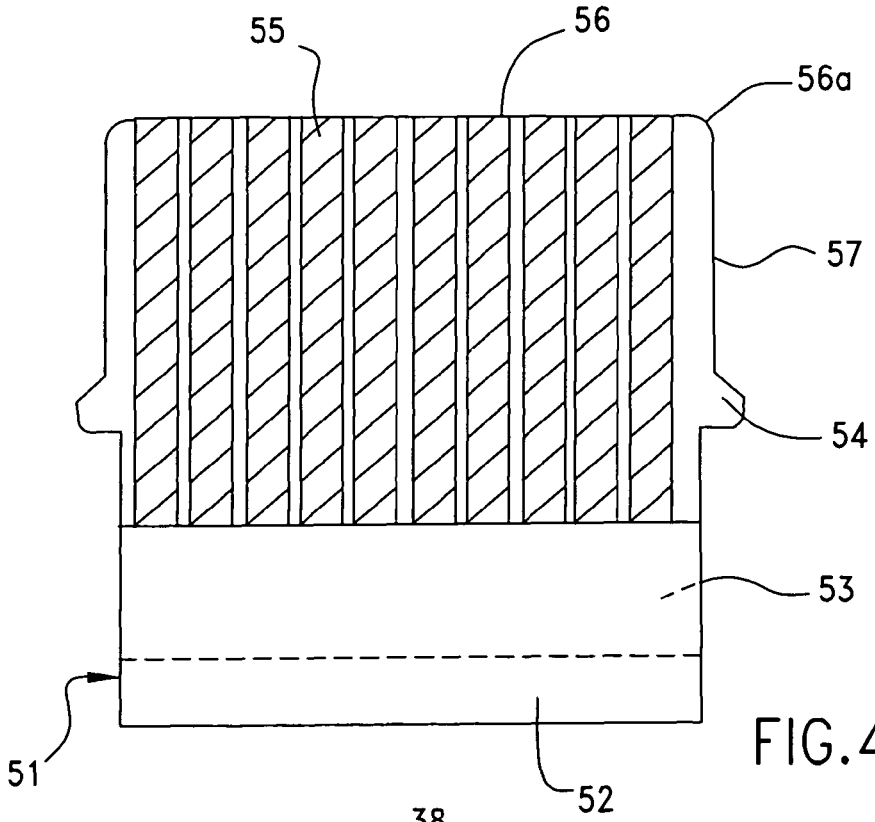
FIG. 4 is a plan view of the insertion of a length of flat flexible cable or flexible printed circuitry that is used with the connectors of the present invention.

In FIG. 3, a cable connector 10 of the present invention is mounted on a substrate 41, such as a circuit board, and is used to electrically connect a flat cable (FFC/FPC) 51, as shown in FIG. 4 to a substrate.

In the preferred embodiment, it should be appreciated that the expressions indicating the directions, such as up, down, left, right, front, and rear, which are used to describe the constructions and operations of the cable connector 10 and the flat cable 51, are relative rather than absolute. These expressions are appropriate when the cable connector 10 and the flat cable 51 are in the position as shown in the drawing figures. However, when the attitudes of the cable connector 10 and the flat cable 51 are changed, these expressions shall be interpreted according to a change in attitude.

Referring to FIG. 4, the flat cable 51 is suitable for use in a narrow mounting spaces, and has an elongated strip-shaped cable body 52 provided with conductive leads 55. One surface at a lengthwise end of the elongated cable body 52 is illustrated in an enlarged dimension. In the interior of the cable body 52, there are a plurality of, e.g., ten leads 55, which are formed of a foil-shaped conductive metal extending lengthwise of the cable body 52, and disposed in side by side order of a predetermined pitch, e.g., about 0.5 mm. The number and the pitch of the lead-wires 55 may be suitably changed. The lead-wires 55 are coated so that they are sandwiched from the upper and lower surfaces thereof, by a film-shaped insulating layer exhibiting electrical insulating property.

Further, a reinforcing plate 53 is applied, such as by adhesives, to one surface of the ends of the cable body 52, i.e., on the bottom of FIG. 4, and the leads 55 are exposed over a predetermined range in a lengthwise direction from the front edge 56 along the top surface shown therein. The reinforcing plate 53 may be formed of a material with a relatively high hardness, such as polyimide, and covers one surface of the lengthwise ends of the cable body 52 over a predetermined lengthwise range from the front edge 56 of the flat cable 51, and over the entire width of the cable body 52. The cable body 52 is inserted from an inserting hole 13, i.e., an opening provided in the cable connector 10, with the surface to which the lead-wires 55 are exposed (the surface side when viewed in FIG. 4) disposed above and opposite the substrate 41.

Ear or tab portions 54 are seen projecting outward from the side edges 57 on both sides of the flat cable 51, and are formed near the end of the flat cable 51. These ear portions 54 are spaced a predetermined distance away from the front edge 56 of the flat cable 51, and are formed as part of the cable body 52 and the reinforcing plate 53. Alternatively, the ear parts 54 may be formed only on the reinforcing plate 53. It is preferable that the portions where both ends of the front edge 56 and side edges 57 are connected to each other, namely front end corner portions 56*a* are shaped as either a rounded corner or as a taper.

Figure 2:
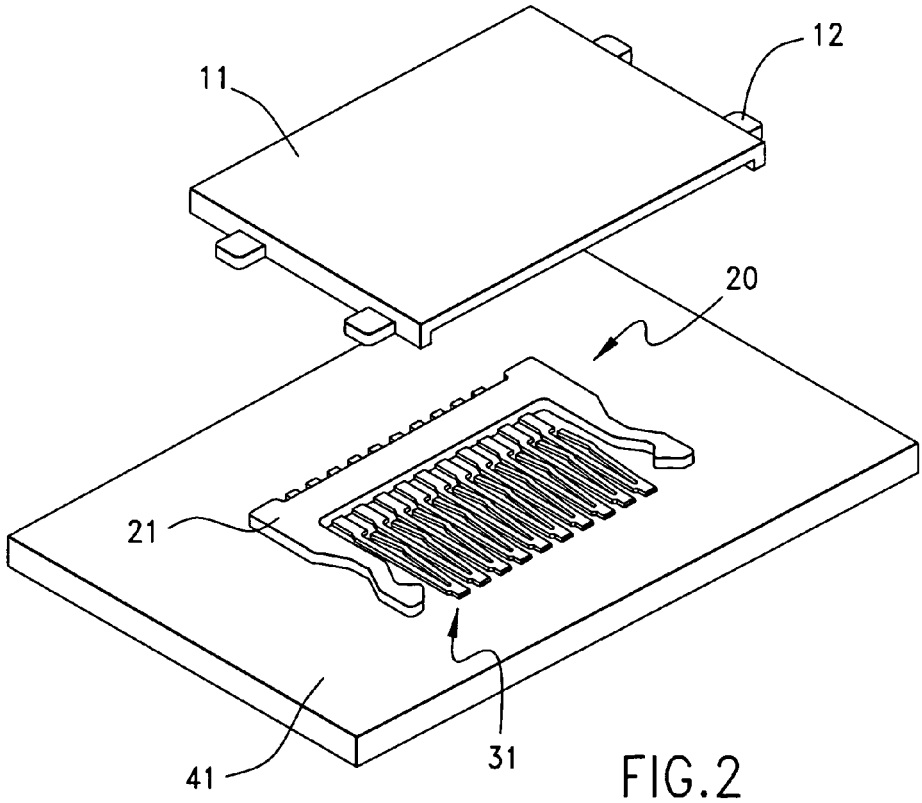
FIG. 2 is an exploded view of a cable connector of the present invention with its cover removed for clarity and with the terminal assembly of FIG. 1 in place on a substrate.

Referring to FIG. 2, the cable connector 10 has a cover member 11 that covers a terminal assembly 20 in its entirety. The cover member 11 is a member in the shape of a thin rectangular box provided with a plurality of flat wall members. On end is left opened, and leg members 12 extend outwardly are formed on the cover member 11 and are connected to the sidewalls on the right and left sides. The leg members 12 secure the cover member 11 to the substrate 41, and are firmly fixed to the substrate 41 with an adhesive or the like. The cover member 11 may be formed of an insulating material such as synthetic resin or ceramics, and is formed integrally with the leg parts 12. Alternatively, the leg parts 12 may be formed separately, and then firmly secured to the cover member 11.

The terminal assembly 20 is a member in the general shape of a flat comb, which has a plurality terminals 31 disposed in side by side order in a predetermined pitch, for example, approximately 0.5 mm, and a terminal support 21 for supporting the terminals 31. The terminal assembly 20 is mounted on the substrate 41, and it is covered with the cover member 11. The number and the pitch of the terminals 31 can be suitably altered so as to correspond to the number and the pitch of the leads 55 of the flat cable 51.

Figure 1:
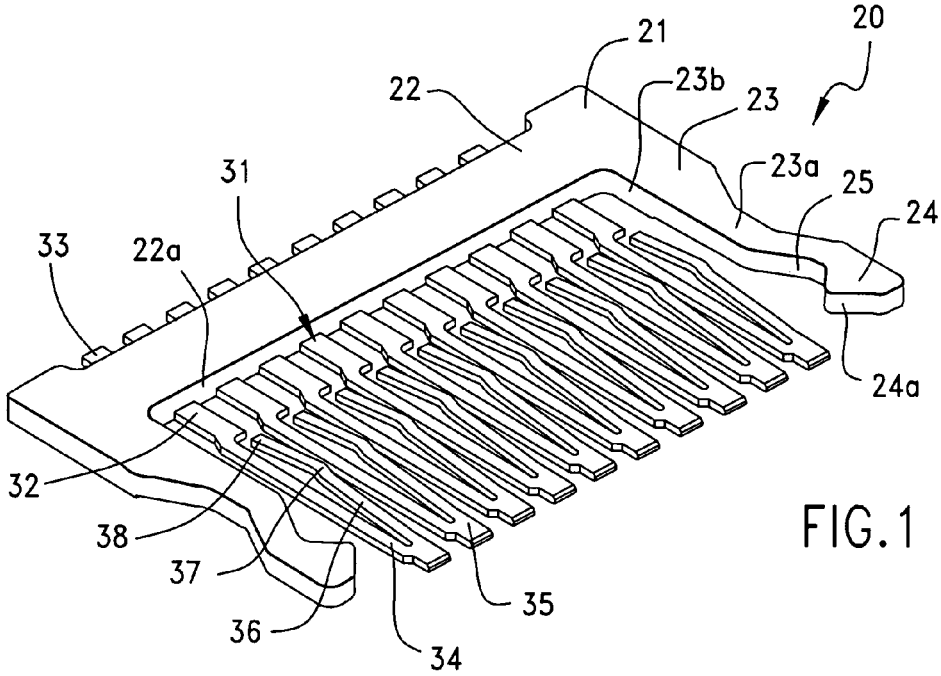
FIG. 1 is a perspective view showing a terminal assembly used in cable connectors constructed in accordance with the principles of the present invention.

Each of the terminals 31 is an elongated strip-shaped member that is formed of a conductive resilient material extends parallel to the insertion direction of the flat cable 51 (from right to left when viewed in FIG. 1). The terminals 31 are disposed side by side in such a manner so that adjacent terminals do not contact each other. Each of the terminals 31 has a body part 32 that extends along the cable length, or parallel to the direction of insertion of the flat cable 51, a connecting part 34 extending from the body part 32 forward toward the inserting hole 13 of the connector, and a front end portion 35 at an end opposite side of the body part 32 in the connecting part 34. Here, the rear portion of the body part 32 is secured to the terminal support 22 so that the terminals are adequately supported. Tail portions 33 of the terminals project from the terminal support 22 so as to connect the terminals to traces on the substrate and surface mount the connector to the substrate.

Connected to the terminal front end portion 35 is a cantilevered contact part 36 with a free end extending toward the rear end portion 33 in the insertion direction of the flat cable 51. Like the connecting part 34, this contact part 36 also is elongated and extends in parallel to the connecting part 34. A free end 38 is provided on the contact part 36 and is located proximate to the connection area between the body part 32 and the connecting part 34. Preferably, the connecting part 34 is disposed so that its lengthwise central axis is offset from the opposite side of the contact part 36 with respect to the lengthwise central axis of the body part 32. In other words, the connecting part 34 is offset on the opposite side of the contact part 36 with respect to the body part 32. This permits a reduction in the distance between the lengthwise central axis of the total area of the contact part 36 and the connecting part 34, and the lengthwise central axis of the body part 32, thereby permitting a reduction in the distance between the adjacent terminals 31, resulting in a small pitch. The contact part 36 is integrally connected at the terminal front end portion 35 to the connecting part 34, without being folded back at the front end portion 35, so that the contact part 36, the front end portion 35, and the connecting part 34 appear on one identical surface. By so doing, it is possible to make the front end portion 35 thinner only with the thickness of the terminal 31. This facilitates the fitting of the flat cable 51 in the connector 10.

The front end portion 35 is firmly fixed to the surface of the substrate 41 by connecting means such as adhesive, or it may be soldered in place to the substrate. The end of the contact part 36 is connected to the front end portion 35, and the free end 38 of the terminal thereby functions as a cantilevered member that is movable vertically with respect to the surface of the substrate 41. A top portion 37 is disposed between the front end portion 35 and the free end 38 in the contact part 36 and is formed to project upward so as to form a ridge or peak when viewed in a lengthwise cross-section. This top portion 37 contacts the exposed leads 55 of the flat cable 51 to establish an electrical connection. When the flat cable 51 is inserted from the inserting hole 13, because the front end portion 35 is firmly secured to the surface of the substrate 41, the front edge 56 of the flat cable 51 travels smoothly in the insertion direction thereof, without abutting against the front end portion 35. In addition, because the upper surface of the contact part 36 has a tilted surface ascending from the front end portion 35 to the top portion 37, the front edge 56 of the flat cable 51 travels smoothly in the insertion direction along the upper surface of the contact part 36.

The terminal support member 21 is formed of an insulative material such as synthetic resin and has a lateral frame part 22 that holds the terminal body parts 32. It also has a pair of holding arm parts 23 that extend from both ends of the lateral frame part 22 to the connector inserting hole 13. The terminal support member 21 is formed so that the lateral frame part 22 is integrated with the body parts 32, by subjecting the body parts 32 of the terminals 31 through over-molding. The lower surface of the lateral frame part 22 which confronts the substrate 41 is preferably flush with the surfaces of the body parts 32 of the terminals 31 which are opposed to the substrate 41. The surface of the lateral frame part 22 on the side on which the inserting hole 13 is disposed, namely a front end surface 22*a* abuts against the front edge 56 of the flat cable 51 that is completely inserted.

The right and left holding arm parts 23 are spaced apart from each other and are provided with guide surfaces 23*b* that extending in the insertion direction. The guide surfaces 23*b* act to guide the side edges 57 of the flat cable 51, and positioning the lateral direction of the flat cable 51, in the direction of arrangement of the terminals 31. The holding arm parts 23 have engaging convex portions 24 that project inwardly at the end on the opposite side of the lateral frame part 22, namely at the free end, and fitting concave portions 25 that are recessed outwardly on the side of the engaging convex portions 24 on which the lateral frame part 22 is disposed. A portion of each of the holding arm parts 23 adjacent to the free end is a narrow portion 23*a* that is small in width, and thus has flexibility, which allows for resilient bending in the direction of extension of the lateral frame part 22, namely the direction of arrangement of the terminals 31. Thus, when the flat cable 51 is inserted, the free ends of the holding arm parts 23 are resiliently displaced in the direction of arrangement of the terminals 31, so that the ear parts 54 of the flat cable 51 fit into the fitting concave portions 25.

As a result, the holding arm parts 23 hold the flat cable 51, thereby grasping the flat cable 51 and preventing disengagement of the flat cable 51 from the connector 10. Then, if the flat cable 51 is subjected to a force in the removal direction, the force by which the flat cable 51 is disengaged from the cable connector 10, the flat cable 51 is held against the displacement in the reverse direction of the insertion direction, by the engagement of the engaging convex portions 24 to the rear ends of the ear parts 54 of the flat cable 51 inserted into the fitting concave portions 25. That is, the engaging convex portions 24 function as stoppers to prevent disengagement of the flat cable 51.

Figure 5:
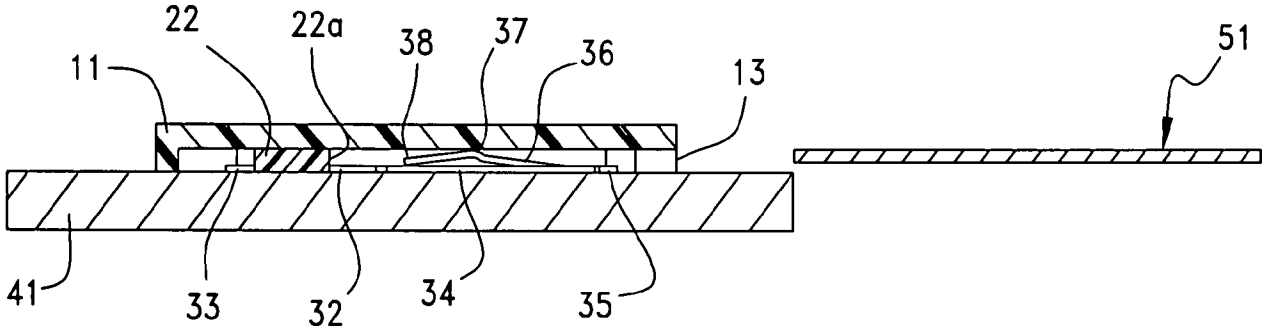
FIG. 5 is a sectional view showing the flat cable spaced apart from but aligned with the cable connector of the present inventions.

The tapered surfaces 24*a* are tilted with respect to the insertion direction of the flat cable 51 on the free end sides of the engaging convex portions 24, so that the front corners 56*a* of the flat cable 51 travel while abutting against the tapered surfaces 24*a*, thereby adjusting the lateral position of the flat cable 51. In addition, the free ends of the holding arm parts 23 are forced outward by the ear parts 54 of the flat cable 51 while abutting against the tapered surfaces 24*a*. The operation of the cable connector 10 having the above-mentioned construction will next be described in terms of connecting the cable to the connector. FIG. 5 is a first sectional view showing the connecting of a flat cable to the cable connector.

It is assumed that the cable connector 10 is mounted on the substrate 41 by soldering the terminal rear end portions 33 to connecting pads on the substrate 41, while the front end portions 35 of the terminals 31 are preferably connected with by adhesive onto the surface of the substrate 41, and the leg parts 12 of the cover member 11 are also connected with adhesive onto the surface of the substrate 41. The adhesive firmly secures the front end portions 35 to the substrate 41 requires no soldering pattern, allowing for effective utilization of the space of the substrate 41. If the substrate 41 has an enough space, the front end portions 35 may be firmly secured by soldering to a soldering pattern formed on the substrate 41, instead of using the adhesive. It is also assumed that the thickness of the terminal support 21 is identical with or slightly smaller than the dimension between the lower surface of the cover member 11 secured to the substrate 41 and the upper surface of the substrate 41.

Referring to FIG. 5, when connecting the flat cable 51 to the cable connector 10, the ends of the flat cable 51 are set parallel with the substrate 41, and the front edge 56 of the flat cable 51 is brought toward the inserting hole 13 of the connector so that the parallel to the inserting hole 13 are parallel with each other. The exposed leads of the flat cable face down in opposition to the upper surface of the substrate 41.

Figure 6:
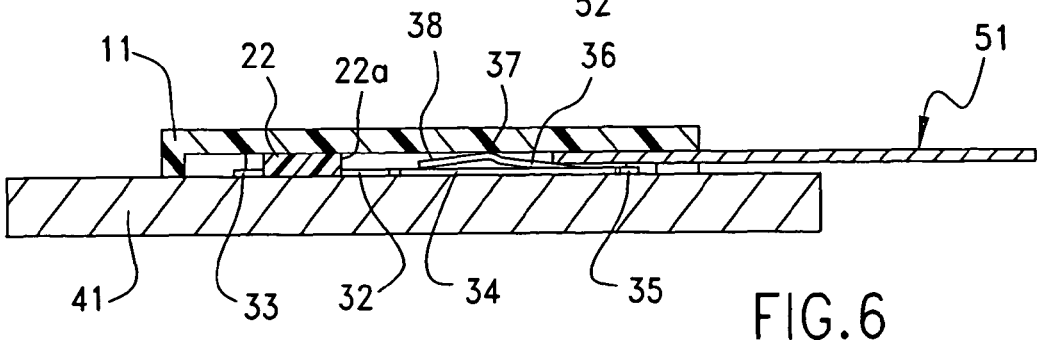
FIG. 6 is a sectional view showing the flat cable partially inserted into the to the cable connector of the present invention.

Referring to FIG. 6, the flat cable 51 is then inserted with the lengthwise end of the flat cable 51 being inserted into the inserting hole 13 of the cable connector 10. The front end portions 35 of the terminals 31 are connected and secured to the surface of the substrate 41 by adhesive or by solder, they are tightly stuck and secured to the substrate 41. Therefore, the front edge 56 of the flat cable 51 is smoothly inserted without abutting against the front end portions 35. The upper surfaces of the contact parts 36 have the tilted surfaces that rise as the flat cable 51 travels further inwardly, and the front edge 56 of the flat cable 51 also smoothly travel along the upper surfaces of the contact parts 36. At this time, the exposed leads 55 on the lower surface of the flat cable 51 abut the upper surfaces of the contact parts 36 to make a connection.

In a case where the position of the flat cable 51 deviates in the lateral direction, namely the direction of arrangement of the terminals 31, when the lengthwise end of the flat cable 51 is inserted from the inserting hole 13 into the cable connector 10, the front end corner portions 56*a* travel while abutting against the tapered surfaces 24*a* formed at the free ends of the holing arm parts 23 of the terminal supporting member 21. With this construction, the position in the direction of arrangement of the terminals 31 of the flat cable 51 can be adjusted so that the leads 55 of the flat cable 51 are in registration with the terminal contact parts 36. When the flat cable 51 further travels inwardly, the side edges 57 of the cable are guided by the guide surfaces 23*b* of the right and left holding arm parts 23. This provides the positioning of the flat cable 51 in the direction of arrangement of the terminals 31, permitting a sure and reliable contact between the respective leads 55 and the corresponding contact parts 36 of the terminals 31.

Figure 7:
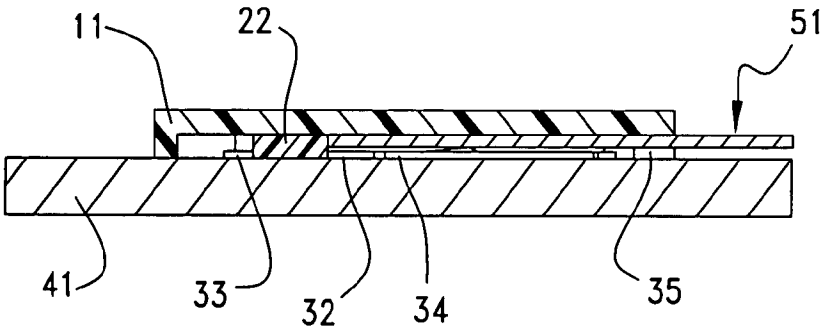
FIG. 7 is a sectional view showing the flat cable in place in the cable connector of the present invention; and, FIG. 8 is a cross-sectional view of a known cable connector.
Figure 8:
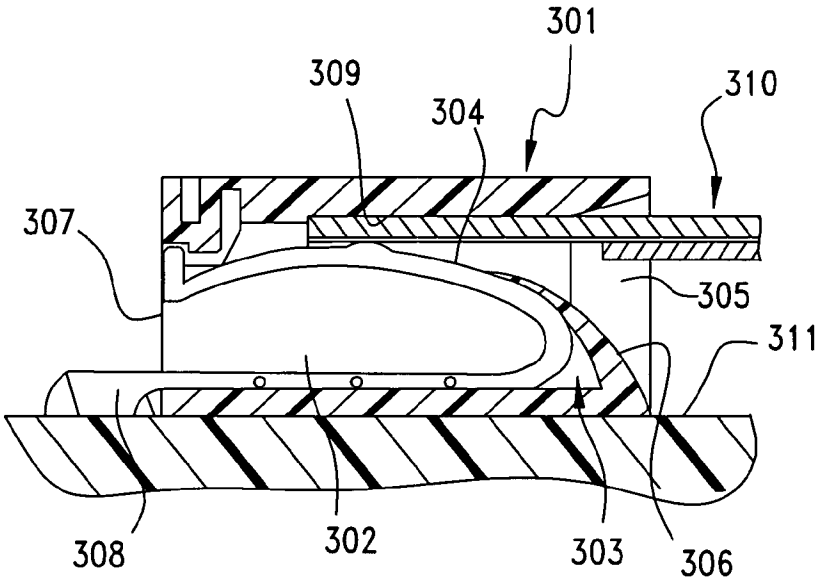
FIG.8 (Prior art)

In FIG. 7, the insertion of the flat cable 51 is completed when the front edge 56 of the flat cable 51 abuts against the front end surface 22*a* of the lateral frame part 22 of the terminal support member 21. Since the thickness of the terminal support member 21 is identical with or slightly smaller than the dimension between the lower surface of the cover member 11 secured to the substrate 41 and the upper surface of the substrate 41, the lateral frame part 22 is not rotated and maintains its stable state at the time of the abutment of the front edge 56 of the flat cable 51 against the front end surface 22*a*. The contact parts 36 of the terminals 31 abut against their respective corresponding leads 55 that are exposed to the lower surface of the flat cable 51, and are electrically connected thereto. This completes the connection of the flat cable 51 to the cable connector 10.

When the flat cable 51 is not inserted, as shown in FIG. 5, the top portions 37 of the contact parts 36 are in contact with, or in an elevated position adjacent to the lower surface of the cover member 11. The free ends 38 of the contact parts 36 are in an elevated position away from the upper surface of the substrate 41. As the flat cable 51 travels in the insertion direction with respect to the cable connector 10, the contact parts 36 are forced downward by the flat cable 51. When the insertion of the flat cable 51 is completed, as shown in FIG. 7, the contact parts 36 are down forced from above by the cable 51, and are deformed resiliently, resulting in an approximately flat shape. At this time, the contact parts 36 are urged upwardly due to the resilient deformation of the contact parts 36, and the top portions 37 of the contact parts 36 press into contact with their corresponding exposed leads 55 on the lower surface of the flat cable 51. It is therefore possible to maintain a superior connection with the lead-wires 55. In this case, the contact parts 36 are displaced by the vertical movements of the free ends 38 with respect to the surface of the substrate 41. When the free ends 38 are brought into contact with the surface of the substrate 41 before the contact parts 38 are displaced, the contact pressure between the top portions 37 and the lead-wires 55 can be increased. In this case, the free ends 38 travel on the surface of the substrate 41 in the insertion direction of the flat cable 51, depending on the displacements of the contact parts 36.

Additionally, the free ends of the holding arm parts 23 are forced outward by the traveling of the ear parts 54 of the flat cable 51 while abutting against the tapered surfaces 24*a*. Therefore, the ear parts 54 fit into the fitting concave portions 25 at the completion of the insertion of the flat cable 51, so that the pair of the holding arm parts 23 holds the flat cable 51, and the flat cable 51 can be resistant against disengagement from the cable connector 10. Since the thickness of the terminal suppor 21 is identical with or slightly smaller than the dimension between the lower surface of the cover member 11 secured to the substrate 41 and the upper surface of the substrate 41, the holding arm parts 23 may deform in the direction of arrangement of the terminals 31, however, do not deform in the direction orthogonal to the direction of arrangement, namely the vertical direction when viewed in FIG. 7. This permits a reliable fitting of the ear parts 54 into the fitting concave portions 25. There is also no possibility of release of the fitting of the ear parts 54 into the fitting concave portions 25, due to the vertical deformation of the holding arm parts 23.

Thus, in the foregoing preferred embodiment, the cable connector 10 includes the terminals 31 that extend in the direction of the insertion of the flat cable 51. Each of the terminals has the front end portion 35 and the rear end portion 33 that are firmly secured to the surface of the substrate 41, and the free end 38 that is movable in the vertical direction to the surface of the substrate 41, and is disposed between the front end portion 35 and the rear end portion 33. This thin and simple structure permits an easy insertion of the flat cable 51 without causing abutment of the front end portions 35 of the terminals 31 against the flat cable 51.

Each of the terminals 31 is provided with the contact part 36 that makes a contact with the corresponding lead-wires 55 of the flat cable 51 and extend in the insertion direction, one end of the contact part 36 being connected to the front end portion 35, and the other being the free end 38. This provides sure and reliable electrical connection of the contact parts 36 with the lead-wires 55, thereby enabling the flat cable 51 to be reliably connected to the cable connector 10.

Further, the cable connector 10 has the terminal support 21 formed of an insulating material, which is provided with the lateral frame part 22 that extends in the direction of arrangement of the terminals 31 and is secured to the body parts 32 of the terminals 31, and the pair of holding arm parts 23 that are connected to the both ends of the lateral frame part 22 and extend in the insertion direction. Hence, the positional relationship between the terminals 31 can be stabilized to facilitate handling of the terminals 31 and facilitate manufacturing of the cable connector 10.

Further, the flat cable 51 has the ear parts 54 projecting from the both ends, and the holding arm parts 23 have the fitting concave parts 25, into which the ear parts 54 are fit. This enables the flat cable 51 to be reliably connected without causing disengagement thereof.

It is to be understood that the present invention is not limited to the foregoing preferred embodiment but it is susceptible of various changes and modifications based on the concept of the present invention, which may be considered as falling within the scope of the present invention.

What is claimed is:

1. A terminal assembly for a flat cable connector, the terminal assembly comprising:

an insulative terminal support member, the terminal support member including a frame part and at least one holding arm part; and a plurality of conductive terminals supported by the terminal supporting member, each terminal including a body part, the body part including opposing front end and tail portions interconnected together by a connecting part, the front end and tail portions each being affixed to a substrate, each terminal further including a contact part and a free end, the contact part extending in a cantilevered fashion rearwardly from the front end portion, being movable vertically with respect to the substrate, and being disposed between the front end and tail portions;

wherein the free end is adapted to travel along the surface of the substrate.

2. The terminal assembly of claim 1, wherein the contact part includes a raised portion disposed intermediate the front and end tail portions.

3. The terminal assembly of claim 2, wherein the contact part extends lengthwise of the terminal assembly alongside the connecting part.

4. A cable connector, the cable connector comprising:

a cover member, the cover member including an opening along one side thereof, and a terminal support member disposed therewithin;

a plurality of conductive terminals terminal supported in side by side order by the terminal support member, the terminals extending lengthwise within the cover member, each terminal including an elongated body part, the body part being supported by the terminal support member, each body part including opposing front end and tail portions for attaching to a substrate and a contact part extending rearwardly alongside the body part and being attached at one end thereof to the terminal front end part and the other end thereof being free such that the contact part is free to deflect, the contact part being configured to define a raised surface in the cover member intermediate the front end and tail portions;

wherein the free end of the contact part is adapted to travel along the surface of the substrate.

5. The connector of claim 4, wherein the support member is U-shaped with a frame part and two holding arm parts, the frame part supporting the body parts and the terminals extending lengthwise between the two holding arm parts.

6. The connector of claim 4, wherein one of the front ends and the tail portions comprise surface mount tails.

7. The connector of claim 5, wherein each holding arm part includes a holding arm that extends inwardly toward the terminals, and engages tabs on a flat cable inserted into the opening.

8. The connector of claim 7, wherein each holding each holding arm includes concave parts that receive the tabs.

* * * * *